US006820379B1

(12) United States Patent
Krinner et al.

(10) Patent No.: US 6,820,379 B1
(45) Date of Patent: Nov. 23, 2004

(54) APPARATUS AND METHOD FOR POSITIONING AND FIXING BEAMS WITH GROUND DOWELS

(75) Inventors: Klaus Krinner, Blumenthal 19, D-94342 Strasskirchen (DE); Guenther Thurner, Strasskirchen (DE); Martin Thurner, Strasskirchen (DE)

(73) Assignee: Klaus Krinner, Strasskirchen (DE)

( * ) Notice: Subject to any disclaimer, the term of this patent is extended or adjusted under 35 U.S.C. 154(b) by 0 days.

(21) Appl. No.: 09/762,714

(22) PCT Filed: Aug. 10, 1999

(86) PCT No.: PCT/EP99/05811

§ 371 (c)(1),
(2), (4) Date: Apr. 6, 2001

(87) PCT Pub. No.: WO00/09834

PCT Pub. Date: Feb. 24, 2000

(30) Foreign Application Priority Data

Aug. 11, 1998 (DE) ..... 198 36 369

(51) Int. Cl.[7] ..... E02D 5/74

(52) U.S. Cl. ..... 52/157; 52/299; 52/741.1; 52/365; 52/366; 52/372; 52/126.5; 52/126.6; 312/351.1; 108/156; 248/156; 248/545; 248/530; 248/188.8; 405/229; 405/230; 405/231

(58) Field of Search ..... 52/157, 299, 741.1, 52/365, 366, 372, 126.5, 126.6; 405/229, 230, 231; 312/351.1; 108/156; 248/156, 545, 530, 188.8

(56) References Cited

U.S. PATENT DOCUMENTS

| | | | | |
|---|---|---|---|---|
| 2,380,692 A | | 7/1945 | Gunnison | |
| 5,333,423 A | * | 8/1994 | Propst | 52/126.6 |
| 5,358,209 A | * | 10/1994 | Ward | 248/545 |
| 5,516,069 A | | 5/1996 | Hanna | |

FOREIGN PATENT DOCUMENTS

| | | |
|---|---|---|
| EP | 0182286 | 5/1986 |
| EP | 0816596 | 1/1998 |
| WO | WO 9708409 | 3/1997 |

* cited by examiner

*Primary Examiner*—Carl D. Friedman
*Assistant Examiner*—Steve Varner
(74) *Attorney, Agent, or Firm*—Jordan and Hamburg LLP

(57) ABSTRACT

A method and an apparatus are described for positioning and fixing beams, in particular made from wood, in particular for the construction of ground foundations, by means of at least one ground dowel. The ground dowel receives, in a retaining part, a ground dowel insert part which can be fixed therein and which possesses a retaining means, attached to a baseplate, for determining the position of the beam relative to the ground dowel insert part, the ground dowel insert part being fixed at least adhesively on the pressed-on beam. After the ground dowel, placed at the desired position and provided with the ground dowel insert part, has been adjusted to the desired height, the beam is pressed on to the retaining means in the desired position. The ground dowel insert part is fixed on the removed beam in accordance with the position determined by the retaining means, and the beam thus positioned, with the ground dowel insert part fixed thereon, is inserted into the retaining section of the ground dowel.

23 Claims, 4 Drawing Sheets

APPARATUS AND METHOD FOR POSITIONING AND FIXING BEAMS WITH GROUND DOWELS

The invention relates to a method for positioning and fixing beams with ground dowels and to an apparatus for implementing the method.

In the erection and positioning of beams or the like, for example in the construction of beam foundations for summerhouses or sheds, the problem always arises, in addition to the necessary horizontal or vertical alignment, of positioning the beam or beams used in their respective positions and also fixing them in those positions. Customarily, securing devices which can be anchored in the soil are used for fixing to the ground, these supporting the beam at their free upper end. The fixing of the beam to the securing device takes place after the securing device has been anchored in the soil, conventionally by the direct screwing, nailing or similar fixing of the positioned beam to the free upper end of the securing device. Direct fixing to the ground dowel has the disadvantage, when positioning or removing and when precisely aligning the beam, that, in each case, all fixing connections have to be made very accurately with a great expense of labor and time.

In practice, ground dowels that can be screwed into the soil in a corkscrew manner and on which the beam is directly fixed have proven their value; in principle, however, securing means that are anchored by being concreted in or driven in may also be used.

If, then, a beam is to be fixed in a desired position in the ground by means of a plurality of these ground dowels, it is necessary for the ground dowels, when anchored in the soil, to be aligned exactly at the desired height and in the desired position. Otherwise, the beam as a whole cannot be fixed in the predetermined position because of the possible positional inaccuracy of the individual ground dowels resulting from the positioning of the fixing securing members, defined before the ground dowel is driven in on the beam. During the driving-in operation, therefore, the position of each individual ground dowel has to be constantly rechecked and any deviation, for example resulting from stones in the soil or the like, subsequently corrected in order to ensure the fixing of the beam in the defined position. Even a slight deviation in the position of a ground dowel can only be corrected by altering the positioning of the corresponding ground dowel. This may, however, result in the loosening of the ground dowel in the soil.

Additional, movable positioning devices as inserts between beam and ground dowel are admittedly known from the prior art, but their design is elaborate and costly: in addition, even if these devices are used, positioning has to take place individually at each ground dowel.

The same applicant's WO 97/08409 has disclosed an apparatus for the vertical arrangement of an object in the shape of a pillar or pole. In this case, the object and the shape of a pillar or pole is provided with a receiving hole which can be pushed over a retaining mandrel of a securing device, especially a ground dowel, in the ground and so fixed. The retaining mandrel can be pressed into the object. As a result of axial play between the retaining mandrel and the receiving hole, vertical and, in principle, horizontal positioning of the object are possible.

The apparatus according to WO 97/08409 has proven its value in practice; even so, it suffers from the disadvantages that, first, the securing devices in the ground require specially molded-on retaining mandrels and, secondly, the objects in pole or post form have to be provided with corresponding receiving holes. This restricts the flexibility of the device in use, because of the necessary preliminary work on the objects to be fixed, and entails additional costs, especially since no securing devices in the ground with standardized receiving sections can be used.

It is an object of the present invention to provide a cost-effective and simple device and a secure and rapid method of positioning and fixing beams which permit positional deviations of the ground dowels within certain limits and nevertheless enable exact positioning without preliminary work and with a low level of effort to position the individual ground dowels.

This object is achieved, according to the invention, by a method having the features according to claim 1 and by an apparatus having the features according to claim 5.

Advantageous further developments are defined in the respective dependent claims.

The method according to the invention offers the advantage that, when a ground dowel to be set to the desired height is placed at the desired position, the positioning of the ground dowel need not, as is customary, be exact in order to achieve exact positioning of a beam. Rather, the exact positioning takes place in the second stage of the method according to the invention as a result of the pressing of the beam into the desired exact position and alignment with a suitable retaining means of a ground dowel insert part, which is inserted into a retaining section of the ground dowel. The positioning of the retaining means relative to the pressed-on beam determines exactly the desired position of the beam as a whole relative to the ground dowel insert part inserted into the retaining section. After the beam is pressed on, the ground dowel insert part adheres permanently thereto. The ground dowel insert part can then be fixed on the beam in accordance with the positioning defined by the pressed-on retaining means. The vertical and/or horizontal position and alignment of the beam is thus defined when the positioned ground dowel insert part is inserted into the retaining section of the ground dowel, without elaborate changes and adjustments of the position of the ground dowel itself having to be undertaken. Also, as a result of the method according to the invention, no elaborate additional positioning devices are necessary between the ground dowel and the ground dowel insert part or between the ground dowel insert part and the beam, since the position of the beam is defined in a simple manner, essentially by it being pushed onto the retaining means.

In a preferred embodiment, the ground dowel insert part, fixed on the beam and inserted into the retaining section of the ground dowel, is additionally fixed in the retaining section of the ground dowel, as a result of which the beam can be secured particularly quickly, simply and securely on the ground dowel, so that, for example, the erection and dismantling of, for example, a temporary beam foundation can take place rapidly.

Preferably, the ground dowel insert part can be fixed on the beam by screwing, in the method according to the invention, which results in particularly secure fixing.

In a further embodiment, the defining of the positioning and/or the fixing of the ground dowel insert part on the beam can also be undertaken by adhesive bonding, which enables a particularly simple and rapid operation.

As a result of a baseplate of the ground dowel insert with a retaining means attached thereto, the apparatus according to the invention for the positioning and fixing of beams has the advantage, by comparison with the prior art, that the position of the beam is fixed in a simple manner in that, after being pressed on, the retaining means fixed on the baseplate of the ground dowel insert part adheres at least to the beam. No complicated and hence costly conventional positioning devices are needed in order to correct deviations of the positioned ground dowel from the exactly desired position.

Also, in the positioning of the beam on a plurality of ground dowels, such as for example in the alignment of a beam foundation, by the corresponding pressing of the beam onto the retaining means of the respective baseplates of all ground dowel insert parts, the problem does not arise that all ground dowels have to be individually exactly positioned. Therefore, the exact position of the beam is reliably defined by the retaining means of the ground dowel insert parts positioned in the retaining sections of the ground dowels and adhering to the beam or connected to the beam.

The arrangement of the retaining means on a baseplate of a ground dowel insert part that can be received in a standardized retaining section of a ground dowel increases the flexibility of use of the ground dowels and makes them cheaper to produce, since no ground dowels with special retaining devices for receiving beams are needed.

In a preferred embodiment of the invention, the retaining means consist of at least one positioning mandrel, which, by pressing on the beam, connects the ground dowel insert part to the beam in accordance with the desired position of the beam in a defined position and, as a result, fixes it at least by adhesion. This permits the particularly reliable and rapid definition of the positioning of the beam merely by pressing it on. As a result of the mandrel-like design, also, no preliminary work on the beam is necessary, which increases the flexibility and possible uses of the apparatus.

The positioning mandrel may be arranged as an individual molding, in particular at the center of the baseplate. However, it is also possible for a plurality of positioning mandrels to be arranged on the baseplate.

A particularly preferred embodiment is one in which at least two sections of the baseplate itself are curved out from the baseplate as positioning mandrels. The position and shape of these sections can, for example, be determined by punching out or cutting out, preferably at two corner or edge regions of the baseplate. Preferably, the regions in question are two diagonally opposite corner regions. Finishing work on the positioning mandrel that can be obtained in this manner may also be necessary, in addition to punching out the shape and bending it out, for example in the form of deburring or grinding to size.

As a result of this embodiment, the production costs are reduced, because no special molding has to be arranged on the baseplate as a positioning mandrel. In general, particularly secure positioning is achieved by means of two or more positioning mandrels.

According to a further embodiment of the invention, the retaining means is designed as an adhesive surface which, as a result of pressing-on of the beam, fixes the ground dowel insert part at least adhesively in a fixed position on the beam in accordance with the desired position of the beam. As a result, particularly simple and even faster positioning is possible. The necessary contact pressure forces can be reduced. In addition, the opportunity is presented not only of using the contact pressure to define the positioning by means of adhesion but also of using adhesive bonding to fix the ground dowel insert part on the beam. This permits a particularly rapid and labor-saving procedure as a result of simultaneous positioning and fixing, without having to remove the beam for fixing purposes.

In an advantageous embodiment, the baseplate may be provided, for the particularly secure fixing of the ground dowel insert part on the beam, with at least one aperture for receiving securing elements for fixing the beam on the ground dowel insert part.

The apertures here may be arranged substantially in a square in the edge regions of the baseplate in order to permit particularly secure fixing.

However, other arrangements with a central aperture in the baseplate are also possible. In addition, preferably, two further apertures may also be provided in the edge regions, the security of the fixing being additionally increased thereby and, at the same time, greater flexibility being provided, for example when fixing beams of relatively small cross section.

Advantageously, the ground dowel insert part is received in the retaining section of the ground dowel by means of a shank-like section, so that it is positioned in the retaining section with axial fixing and securely.

The shank-like section is preferably cylindrically molded, with an external diameter that substantially corresponds to the internal diameter of the retaining section of the ground dowel, so that the receiving of the shank-like section in the retaining section of the ground dowel, which fixes the axial position, is possible in a particularly reliable manner.

The shank-like section can also, preferably, be molded so that the external diameter of the cylindrical section is substantially less than the internal diameter of the retaining section of the ground dowel and the shank-like section widens at its free end, in the manner of a collar, substantially up to the internal diameter of the retaining section. As a result, first, the shank-like section is fixed in its axial position when inserted into the retaining section of the ground dowel by the collar-shaped diametral widening. Secondly, the shank-like section, as a result of its lesser external diameter, additionally serves to be receivable in a tilted position in the retaining section. This offers additional flexibility, particularly with the vertical but also with the horizontal alignment and positioning of beams while substantially retaining the fixing of the axial position of the ground dowel insert part in the retaining section of the ground dowel.

Fixing of the shank-like section of the ground dowel insert part in the retaining section of the ground dowel by means of a set-screw is particularly advantageous, as in this way particularly secure and strong fixing of the beam and of the ground dowel insert part attached thereto on the ground dowel is possible.

The invention will be explained in detail below with reference to an example of embodiment and to the attached drawings.

Figure 3A:
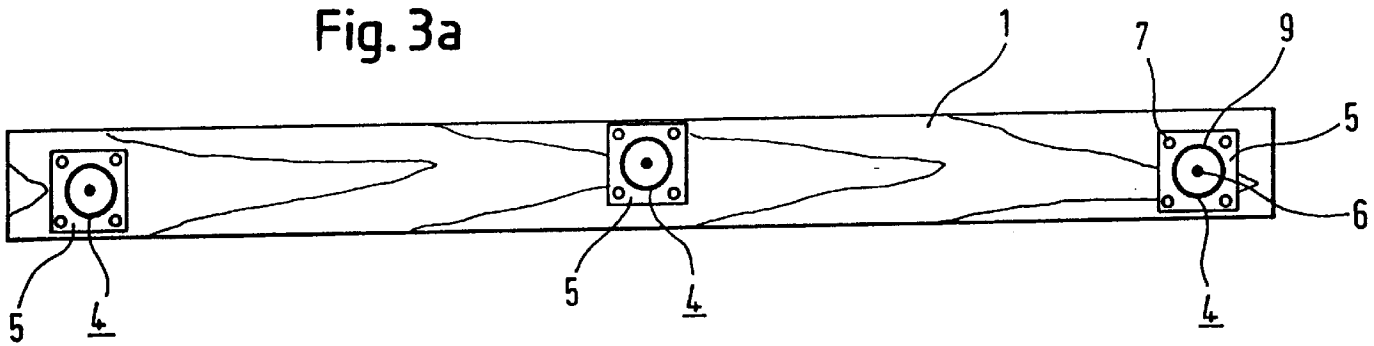
Figure 3B:
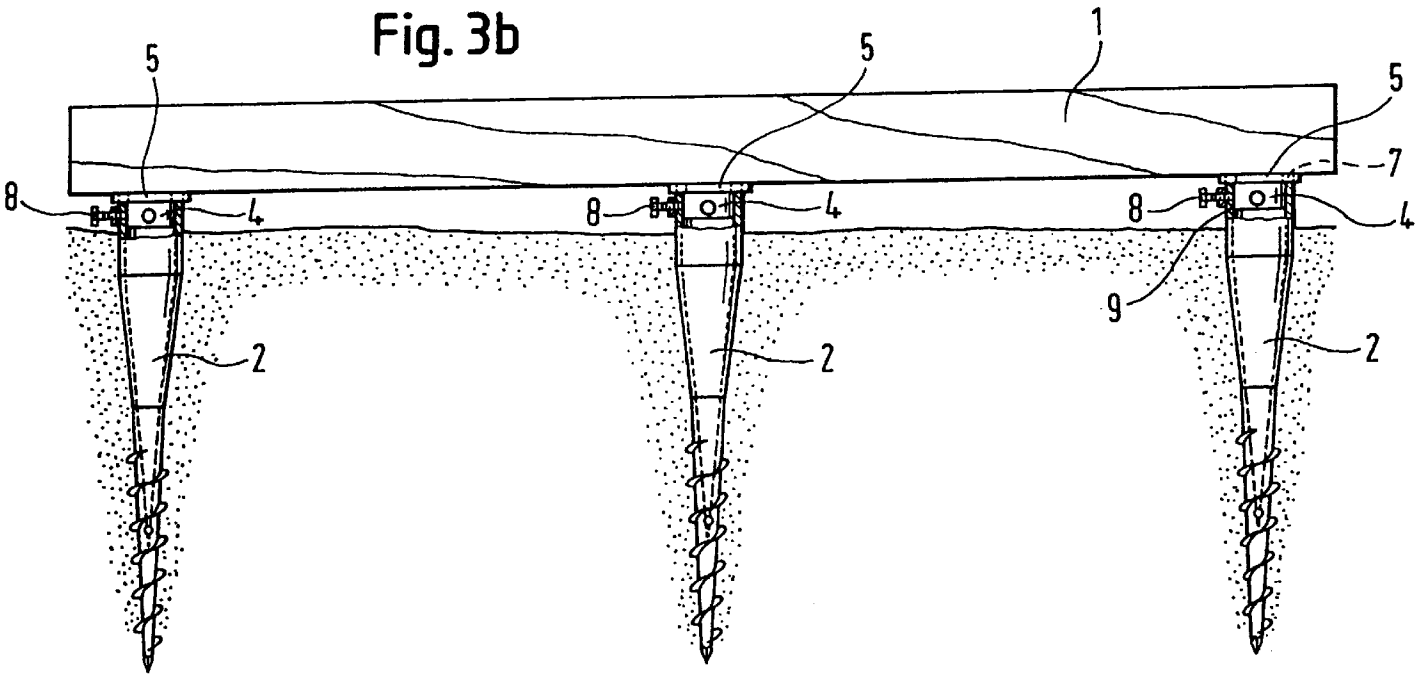
Figure 4:
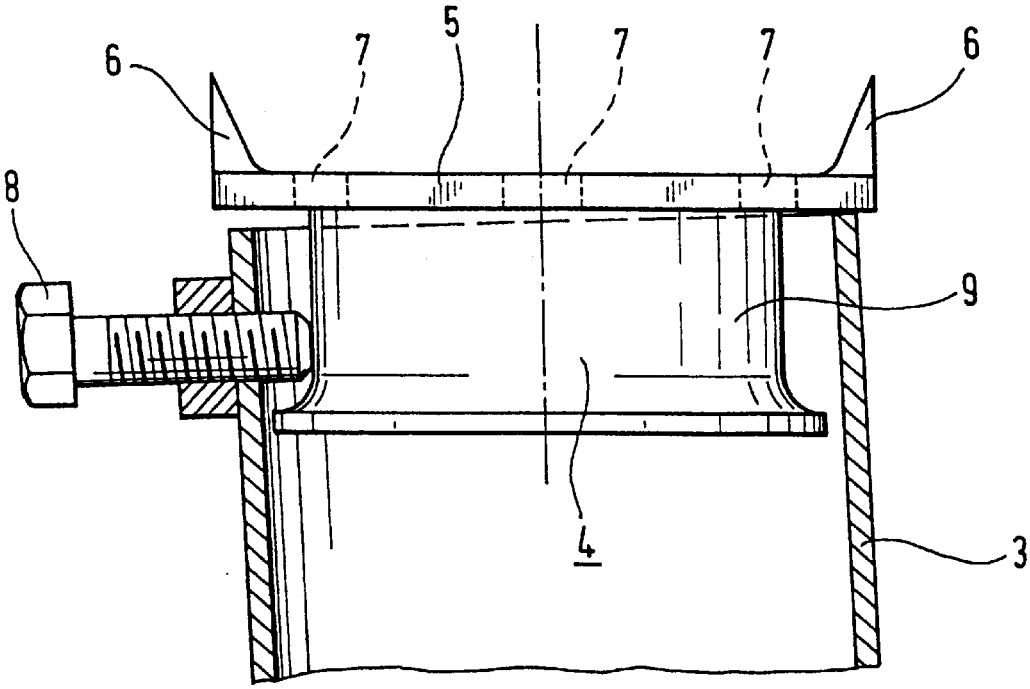

FIG. 3*a* shows a plan view of a beam and ground dowel insert parts attached thereto according to a preferred embodiment of the invention,;

FIG. 3*b* shows a lateral view of the beam and of the ground dowel insert parts attached thereto, and also of the remaining apparatus of a preferred embodiment of the invention; and FIG. 4 shows a lateral view of a further embodiment of the apparatus according to the invention for positioning and fixing beams.

Figure 1:
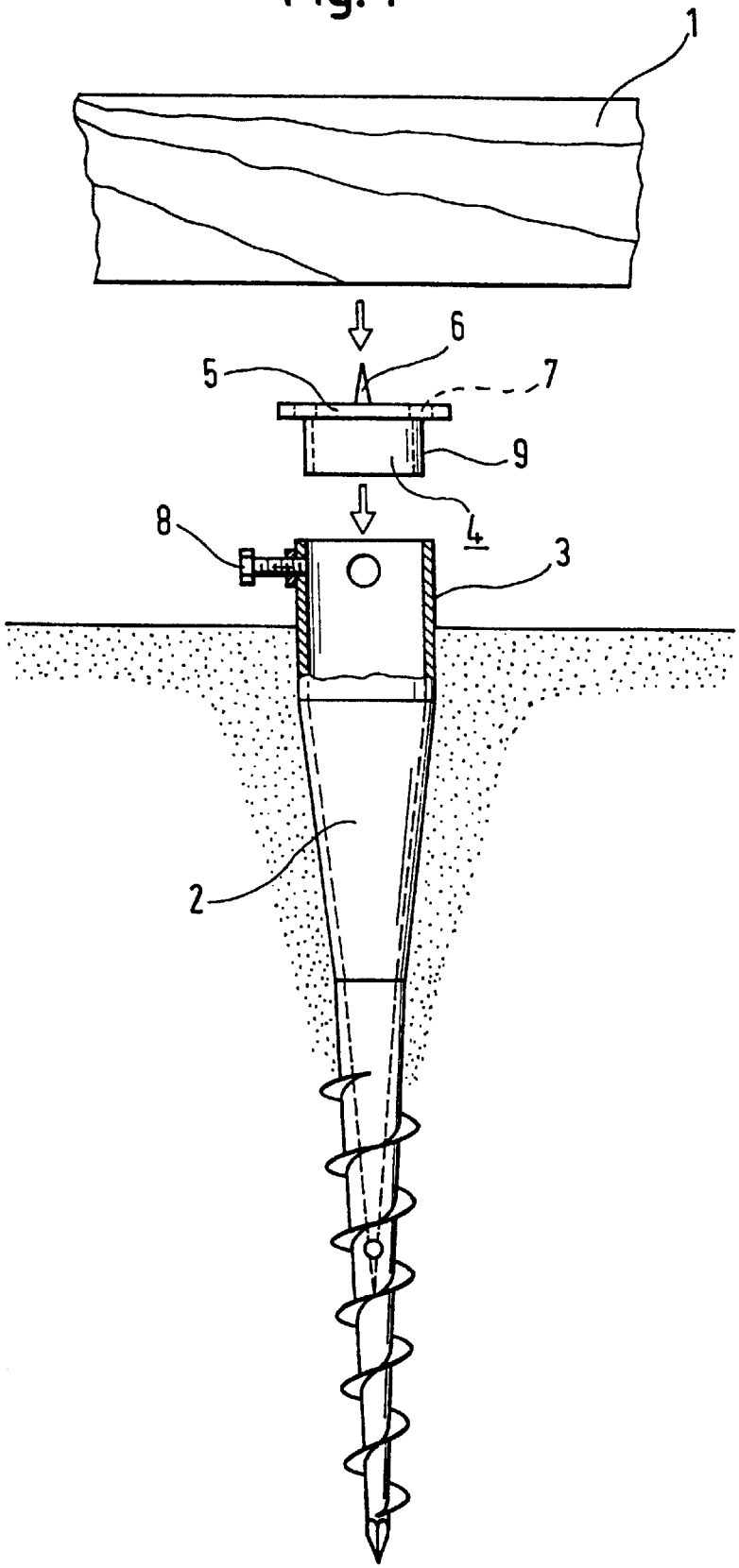
FIG. 1 shows an exploded lateral view of a preferred embodiment of the apparatus according to the invention for positioning and fixing beams.

FIG. 1 shows a preferred embodiment of the apparatus according to the invention for positioning and fixing beams.

The apparatus shown positions and fixes a beam 1 and consists of a ground dowel 2, screwed into the soil, having a standardized retaining section 3 to receive, with fixing of the axial position, a substantially cylindrical shank 9 of a ground dowel insert part 4. The ground dowel insert part 4 has a baseplate 5 with a retaining means molded as a positioning mandrel 6 for determining the position of the beam 1, and apertures 7 for receiving securing elements, especially screws or nails, for fixing on the beam 1. The shank 9 of the ground dowel insert part 4 may be fixed in a retaining section 3 of the ground dowel 2 by means of a set-screw 8.

The preferred embodiment of the method according to the invention clarifies the action of the individual components.

After the ground dowel 2 has been placed at the desired position, it is adjusted to the desired height by being appropriately twisted in or twisted out. This state is shown in FIG. 1, so that the upper edge of the retaining section 3 is already at the desired height. Now, as indicated by the arrow between the ground dowel insert part 4 and the ground dowel 2, the ground dowel insert part 4 is inserted by its shank 9 into the retaining section 3 of the ground dowel 2. The baseplate 5 here is preferably designed so that it forms a stop for the shank 9 on the retaining section 3. In general, it is not the upper edge of the retaining section 3 but the baseplate 5 with the retaining means that forms the reference surface or reference point for exact height adjustment.

In the next stage, the beam is then pressed into the desired position and alignment on the positioning mandrel 6, as is indicated by the second arrow between the beam 1 and the ground dowel insert part 4. As a result, the positioning mandrel 6 is pressed into the beam 1. The beam 1 is then in ideal contact at least at one point on the baseplate 5. The positioning of the beam 1 relative to the ground dowel insert part 4 is defined by the pressed-on positioning mandrel 6. As a result of the pressing in of the positioning mandrel 6, the ground dowel inset part 4 is also fixed at least by adhesion on the pressed-on beam 1 and releasably connected thereto.

It is however possible for further conventional positioning and/or leveling devices to be present between the ground dowel insert part 4 and the retaining section 3 of the ground dowel 2, or of another suitable point, in order to allow the possibility of additional adjustment of the positioning. This, however, is purely optional and in no way restricts the advantageous procedure and function according to the invention.

The beam 1 can now be removed again. The ground dowel insert part 4 is then screwed tight, preferably by means of screws through, for preference, three or four apertures 7 in the baseplate 5, in accordance with the positioning on the beam 1 determined in the previous stage.

The beam 1 with the ground dowel insert part 4 fixed thereto is now placed on the ground dowel 2 again. If a further, stronger fixing is needed, the shank 9 of the ground dowel insert part 4, inserted into the retaining section 3, can be fixed by the set-screw 8.

Figure 2:
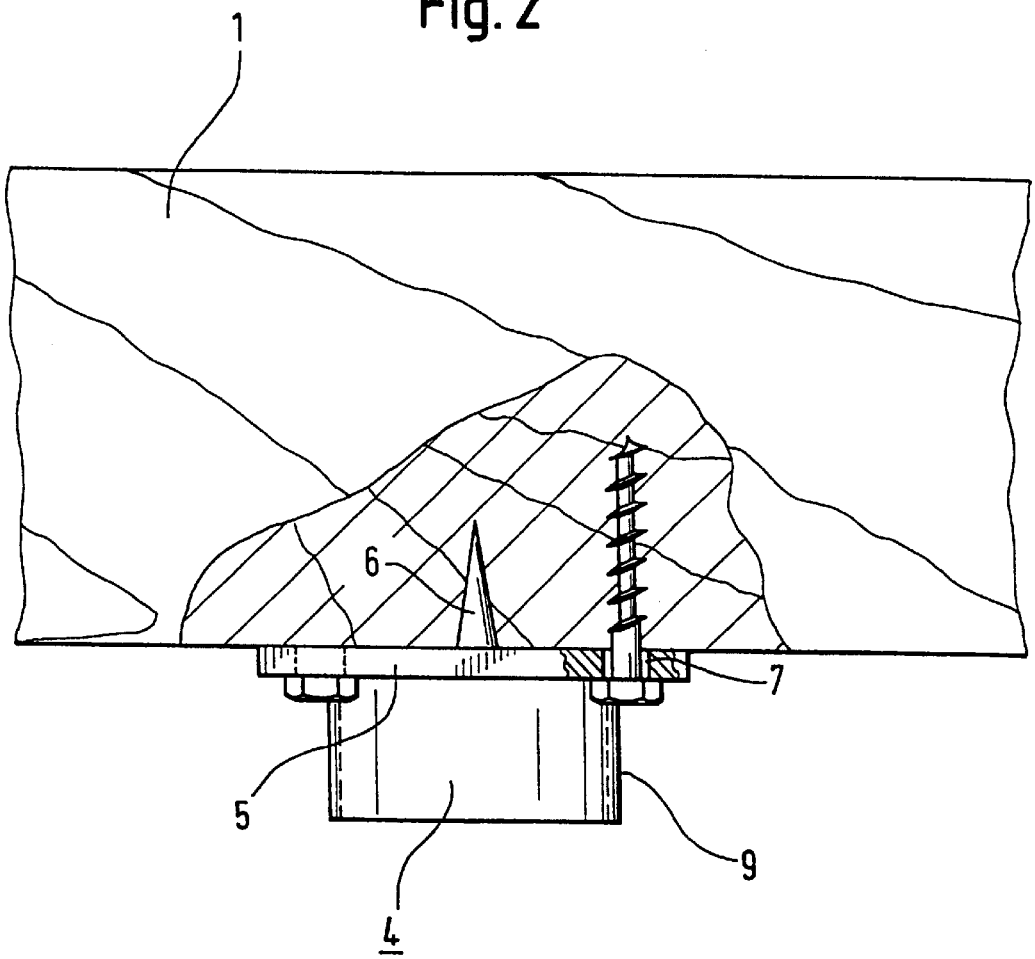
FIG. 2 shows a view in partial section of the ground dowel insert part of a preferred embodiment of the invention.

FIG. 2 shows a view in partial section of the preferred embodiment of the ground dowel insert part 4 according to the invention.

What is shown is the ground dowel insert part 4 provided with the positioning mandrel 6, resting substantially flat on the beam 1 by means of the baseplate 5 and fixed to the beam 1 by means of screws through the apertures 7 in the baseplate 5.

It is also possible for the baseplate 5 to have an adhesive surface instead of or in addition to the positioning mandrel 6. It is then possible, as a result of the adhesive action when the beam is pressed onto the retaining means, for the ground dowel insert part 4 not only to be adhesively fixed in order to determine the positioning on the beam 1 but also for the permanent fixing which is otherwise provided by means of the screws to be provided in the earlier contact pressure step by means of adhesion. Additional screwing or nailing is, of course, possible if the suitable beam material is selected and the apertures 7 are present.

FIG. 3*a* and FIG. 3*b* show an example of an application of the preferred apparatus according to the invention and of the method in the positioning and alignment of a beam 1 as is used, for example, in the construction of a beam foundation for summerhouses.

The beam 1 is aligned in its vertical position by means of three ground dowels according to the procedures described in connection with FIG. 1 and FIG. 2. FIG. 3*a* shows the arrangement of the ground dowel insert parts 4, pressed on and fixed by means of screws through the apertures 7 on the beam 1 in accordance with the exact position of the beam 1. The ground dowel insert parts are not in a line, because the positioning of the ground dowels 2 deviates from the precisely desired positioning when they are twisted in at the desired points, for example as a result of stones in the soil. The offset arrangement of the pressed-on ground dowel insert parts 4 compensates for these position deviations; the beam 1 is precisely aligned and positioned.

In FIG. 3*b*, the beam 1 from FIG. 3*a* is inserted, by means of the substantially cylindrical shanks 9 of the ground dowel insert parts 4 fixed on the beam 1, into the retaining sections 3 of the ground dowels 2 and fixed therein by means of the set-screws 8. Horizontal alignment takes place by twisting the individual ground dowels in or out as appropriate. Because of the fixing of the ground dowel insert parts 4 by the jamming of the shanks 9, simple adjustment of the height of the individual ground dowels 2 by loosening the corresponding set-screw 8 is possible at any time without it being necessary, in a conventional manner, to loosen the corresponding fixing on the beam 1 itself.

FIG. 4 shows the retaining section 3 of a ground dowel twisted obliquely into the soil and having an inserted ground dowel insert part 4, in accordance with a further embodiment of the invention. The ground dowel insert part possesses two positioning mandrels 6 bent out from the baseplate 5, which are punched free in corner or edge regions of the baseplate 5 and then bent out from the plane of the baseplate. The apertures 7 for receiving the fixing means are arranged diagonally opposite, with one of the apertures 7 in the middle of the baseplate 5. The baseplate 5 is aligned perpendicularly. This is achieved by the tilted insertion of the shank-like section 9 of the ground dowel insert part 4 into the retaining section 3 of the ground dowel. The secure axial positioning of the shank-like section 9 is achieved as a result of the collar-like widening at its free end, which essentially has the same diameter as the interior of the retaining section 3. Secure fixing of the ground dowel insert part 4 in the retaining section 3 can be achieved by jamming the shank-like section 9 by means of the set-screw 8. The operation of positioning the beam takes place in the manner previously described above.

LIST OF REFERENCES

1 beam
2 ground dowel
3 retaining section
4 ground dowel insert part

5 baseplate
6 positioning mandrel
7 aperture
8 set screw
9 shank

What is claimed is:

1. A method for positioning and fixing beams for the construction of beam foundations by means of at least one ground dowel and a ground dowel insert part having a retaining means for fixing the position of the beam, which ground dowel insert part is plugged into a retaining section of the ground dowel and fixed there and to the beam, comprising:

adjusting the ground dowel positioned in a desired place and provided with the ground dowel insert part to a desired height;

pressing the beam into a desired position on the retaining means;

removing the beam and fixing the ground dowel insert part on the beam in accordance with the position defined by the pressed-on retaining means; and placing the beam with the fixed ground dowel insert part on the ground dowel by inserting the ground dowel insert part into the retaining section of the ground dowel.

2. The method as claimed in claim 1, wherein the ground dowel insert part is fixed in the retaining section of the ground dowel.

3. The method as claimed in claim 1 or 2, wherein the ground dowel insert part is fixed by being screwed to the beam.

4. The method as claimed in claim 1 or 2, wherein the ground dowel insert part is adhesively bonded to the beam.

5. An apparatus for positioning and fixing beams for the construction of beam foundations comprising: at least one ground dowel and one ground dowel insert part which can be plugged into a retaining section of the ground dowel and can be fixed there and which has a retaining means for fixing the position of the beam relative to the ground dowel insert part, wherein the ground dowel insert part has a baseplate to which the retaining means is attached, the retaining means being so designed that the ground dowel insert part is at least adhesively fixed on the pressed-on beam, and the retaining means is designed as an adhesive surface on the baseplate.

6. The apparatus as claimed in claim 5, wherein the baseplate possesses at least one aperture for receiving securing members to fix the ground dowel insert part on the beam.

7. The apparatus as claimed in claim 5, wherein the ground dowel insert part can be plugged into the retaining section of the ground dowel by means of a shank-like section.

8. The apparatus as claimed in claim 7, wherein the retaining section of the ground dowel possesses a set-screw for fixing the shank-like section of the ground dowel insert part.

9. An apparatus for positioning and fixing a beam for beam foundations, comprising:

a ground dowel having a retaining section and a ground engaging section, the retaining section being disposed above the ground engaging section;

a ground dowel insert part having a beam accepting member having a top side with at least one engaging device thereon configured to penetrate and contact the beam by displacement of material of the beam to affix the ground dowel insert part to the beam by frictional engagement, the beam accepting member having a bottom side from which extends an insertion member; and the retaining section of the ground dowel being configured to engage and retain the insertion member of the ground dowel insert part.

10. The apparatus of claim 9 wherein the ground engaging section is configured to penetrate the ground such that rotation permits vertical positioning.

11. The apparatus as claimed 10, in wherein the at least one engaging device includes a positioning mandrel extending from the top side and having a pointed top for penetrating the beam to affix the beam to the ground dowel insert part.

12. The apparatus as claimed in one of claim 11, wherein the retaining section defines an aperture engaging the insertion member and the retaining section includes a retaining device for clamping the insertion member.

13. The apparatus as claimed in claim 12, wherein the beam accepting member is a baseplate which defines at least one aperture for receiving a securing member to fix the beam accepting member on the beam.

14. The apparatus as claimed in one of claim 10, wherein the retaining section defines an aperture engaging the insertion member and the retaining section includes a retaining device for clamping the insertion member.

15. The apparatus as claimed in claim 14, wherein the beam accepting member is a baseplate which defines at least one aperture for receiving a securing member to fix the beam accepting member on the beam.

16. The apparatus as claimed in one of claim 9, wherein the retaining section defines an aperture engaging the insertion member and the retaining section includes a retaining device for clamping the insertion member.

17. The apparatus as claimed in claim 16, wherein the beam accepting member is a baseplate which defines at least one aperture for receiving a securing member to fix the beam accepting member on the beam.

18. The apparatus as claimed in claim 16, wherein the at least one engaging device is at least one positioning mandrel extending from the top side and having a pointed top for penetrating the beam to affix the beam to the ground dowel insert part.

19. The apparatus as claimed in claim 16, wherein the at least one engaging device includes an adhesive surface layer for adhering the beam to the ground dowel insert part.

20. The apparatus as claimed in claim 9, wherein the beam accepting member is a baseplate which defines at least one aperture for receiving a securing member to fix the beam accepting member on the beam.

21. The apparatus as claimed as claim 9, wherein the at least one engaging device includes an adhesive surface layer for adhering the beam to the ground dowel insert part.

22. The apparatus as claimed in one of claimed of claim 21 wherein the retaining section defines an aperture engaging the insertion member and the retaining section includes a retaining device for clamping the insertion member.

23. The apparatus as claimed in claim 22, wherein the beam accepting member is a baseplate which defines at least one aperture for receiving a securing member to fix the beam accepting member on the beam.

* * * * *